US010553389B2

(12) United States Patent
Holch et al.

(10) Patent No.: US 10,553,389 B2
(45) Date of Patent: Feb. 4, 2020

(54) X-RAY EMITTER AND METHOD FOR COMPENSATING FOR A FOCAL SPOT MOVEMENT

(71) Applicant: Siemens Healthcare GmbH, Erlangen (DE)

(72) Inventors: Florian Holch, Nuremberg (DE); Kai-Uwe Taubenreuther, Schellenberg (DE); Thomas Weidinger, Erlangen (DE)

(73) Assignee: SIEMENS HEALTHCARE GMBH, Erlangen (DE)

( * ) Notice: Subject to any disclaimer, the term of this patent is extended or adjusted under 35 U.S.C. 154(b) by 120 days.

(21) Appl. No.: 15/912,723

(22) Filed: Mar. 6, 2018

(65) Prior Publication Data

US 2018/0261420 A1 Sep. 13, 2018

(30) Foreign Application Priority Data

Mar. 9, 2017 (DE) ..... 10 2017 203 932

(51) Int. Cl.
*H01J 35/30* (2006.01)
*H01J 35/14* (2006.01)
(Continued)

(52) U.S. Cl.
CPC ..... *H01J 35/305* (2013.01); *H01J 35/14* (2013.01); *H05G 1/52* (2013.01); *H01J 35/10* (2013.01)

(58) Field of Classification Search
CPC ..... H01J 2235/10; H01J 35/10; H01J 35/14; H01J 35/305; H05G 1/52
See application file for complete search history.

(56) References Cited

U.S. PATENT DOCUMENTS 5,550,889 A 8/1996 Gard et al.
6,252,935 B1 6/2001 Styrnol et al.
(Continued)

FOREIGN PATENT DOCUMENTS

CN 102246256 A 11/2011
CN 103356204 A 10/2013
(Continued)

OTHER PUBLICATIONS

Chinese Office Action and English translation thereof dated Jul. 9, 2019.
(Continued)

*Primary Examiner* — Marcus H Taningco
(74) *Attorney, Agent, or Firm* — Harness, Dickey & Pierce, P.L.C.

(57) ABSTRACT

An X-ray emitter includes an anode rotatably mounted arranged inside a vacuum housing. It can be set into rotation by an electric drive. In the region of a focal spot, the anode can be exposed to an electron beam emitted by a cathode. According to an embodiment of the invention, a control unit is configured to activate an electromagnetic deflection unit that deflects the electron beam as a function of at least one operating parameter of the electric drive such that a movement of the focal spot, caused by electromagnetic fields of the electric drive, can be at least partly compensated for. An embodiment of the invention further relates to a method for compensating for a focal spot movement when X-ray emitters in operation.

27 Claims, 3 Drawing Sheets

(51) Int. Cl.
*H05G 1/52* (2006.01)
*H01J 35/10* (2006.01)

(56) References Cited

U.S. PATENT DOCUMENTS

| | | | | |
|---|---|---|---|---|
| 6,977,991 | B1 * | 12/2005 | Neumeier | H01J 35/10 378/137 |
| 2003/0103597 | A1 | 6/2003 | Sklebitz | |
| 2004/0101110 | A1 * | 5/2004 | Eppler | G01N 23/04 378/207 |
| 2004/0190682 | A1 | 9/2004 | Deuringer et al. | |
| 2005/0094762 | A1 * | 5/2005 | Dunham | A61B 6/06 378/19 |
| 2010/0074392 | A1 * | 3/2010 | Behling | H01J 35/06 378/4 |
| 2011/0235784 | A1 | 9/2011 | Behling | |
| 2016/0196950 | A1 * | 7/2016 | Ishihara | H01J 35/14 378/138 |
| 2017/0318651 | A1 * | 11/2017 | Canfield | H01J 35/14 |
| 2017/0318652 | A1 | 11/2017 | Meiler et al. | |
| 2018/0343728 | A1 * | 11/2018 | Zhang | H01J 35/14 |

FOREIGN PATENT DOCUMENTS

| | | | |
|---|---|---|---|
| CN | 107452583 | A | 12/2017 |
| DE | 19832972 | A1 | 1/2000 |
| DE | 10038176 | C1 | 8/2001 |
| DE | 10301071 | A1 | 7/2004 |
| DE | 102012204841 | A1 | 10/2013 |

OTHER PUBLICATIONS

German Office Action dated Oct. 5, 2017 for German Application No. 2016P21346DE.

Chinese Office Action and English translation thereof dated Sep. 23, 2019.

* cited by examiner

X-RAY EMITTER AND METHOD FOR COMPENSATING FOR A FOCAL SPOT MOVEMENT

PRIORITY STATEMENT

The present application hereby claims priority under 35 U.S.C. § 119 to German patent application number DE 102017203932.9 filed Mar. 9, 2017, the entire contents of which are hereby incorporated herein by reference.

FIELD

At least one embodiment of the invention relates to an X-ray emitter with an anode arranged inside a vacuum housing, wherein at least the anode is rotatably mounted and can be set into rotation by an electric drive, wherein the anode can be exposed in the region of a focal spot to an electron beam emitted by a cathode. The invention further relates to a method for compensating for a focal spot movement when such an X-ray emitter is in operation.

BACKGROUND

X-ray installations, in particular medical imaging X-ray equipment such as computer tomography X-ray equipment, for example, have one or a plurality of X-ray emitters, whose rotatably mounted rotary anodes for generating X-ray radiation can be exposed to optionally focused electron beams. The region, in which the electron beam impinges on the material of the rotary anode, is usually referred to as the focal spot. With X-ray emitters, the anodes of which are designed as rotary anodes, normally these anodes are typically set into rotation via an electric drive, in order to distribute the heat emerging in the focal spot over a larger region of the rotary anode.

It has transpired that the position and the extent of the focal spot can vary when the X-ray emitter is operated. This causes fluctuations in the X-ray radiation that is generated, which can have a negative effect on the quality of the X-ray images acquired.

To counteract this, DE 103 01 071 A1 proposes carrying out a determination of the position of the focal spot and regulating the position of the focal spot in the traditional way as a control variable, that is, a value for the variable control parameters required for adjusting the control variable is generated using a control deviation of a measured actual value for the control variable from a given set value. The disadvantage with such a procedure is that measurable deviations in the control variable—in this case, that is, the focal spot position—first have to be available for a compensation to be able to ensue.

Due to the control dynamics, a movement of the focal spot which depends on the amplitude of the original, that is, not on the compensated focal spot movement, is not included. Moreover, with a direct, active control, it is necessary to determine the spatial position and extent of the focal spot, which involves a plurality of sensors. Nevertheless, such methods that are implemented in the form of control circuits are designed to detect and, where necessary compensate for, disruptions of both known and unknown origin by determining the focal spot position.

SUMMARY

At least one embodiment of the invention provides an apparatus and/or a method that allow an efficient compensation of focal spot movement.

With regard to the apparatus, at least one embodiment is directed to an X-ray emitter.

Advantageous embodiments of the invention form the subject matter of the claims.

An X-ray emitter of at least one embodiment comprises an anode arranged inside a vacuum housing, wherein at least the anode is rotatably mounted and can be set into rotation by an electric drive. In the region of a focal spot, the anode can be exposed to an electron beam emitted by a cathode. According to at least one embodiment of the invention, a control unit is provided which activates an electromagnetic deflection unit that deflects the electron beam such that a movement of the focal spot caused by electromagnetic fields of the electric drive can be at least partly compensated for, as a function of at least one operating parameter of the electric drive.

At least one embodiment of the invention is directed to a method for compensating for a focal spot movement. The advantages associated therewith emerge directly from the description set out in the aforementioned with reference to the X-ray emitter according to embodiments of the present invention.

In a method of at least one embodiment for compensating for the focal spot movement when the aforementioned X-ray emitter is in operation, an anode arranged inside a vacuum housing is provided, which anode is exposed to an electron beam in order to generate X-ray radiation. The anode at least is rotatably mounted for this purpose and is set into rotation by an electric drive.

According to at least one embodiment of the invention, a control unit activates an electromagnetic deflection unit that deflects an electron beam as a function of at least one operating parameter of the electric drive such that a movement of the focal spot caused by electromagnetic fields in the electric drive is at least partly compensated for.

BRIEF DESCRIPTION OF THE DRAWINGS

The properties, features and advantages of the invention described in the aforementioned, together with the manner in which they are achieved, will emerge more clearly and comprehensibly from the embodiments that are described hereinafter, which are explained in greater detail with reference to the drawings.

For a further description of the invention, reference is made to the embodiments shown in the figures in the drawing. Here, in diagram form.

Figure 1:
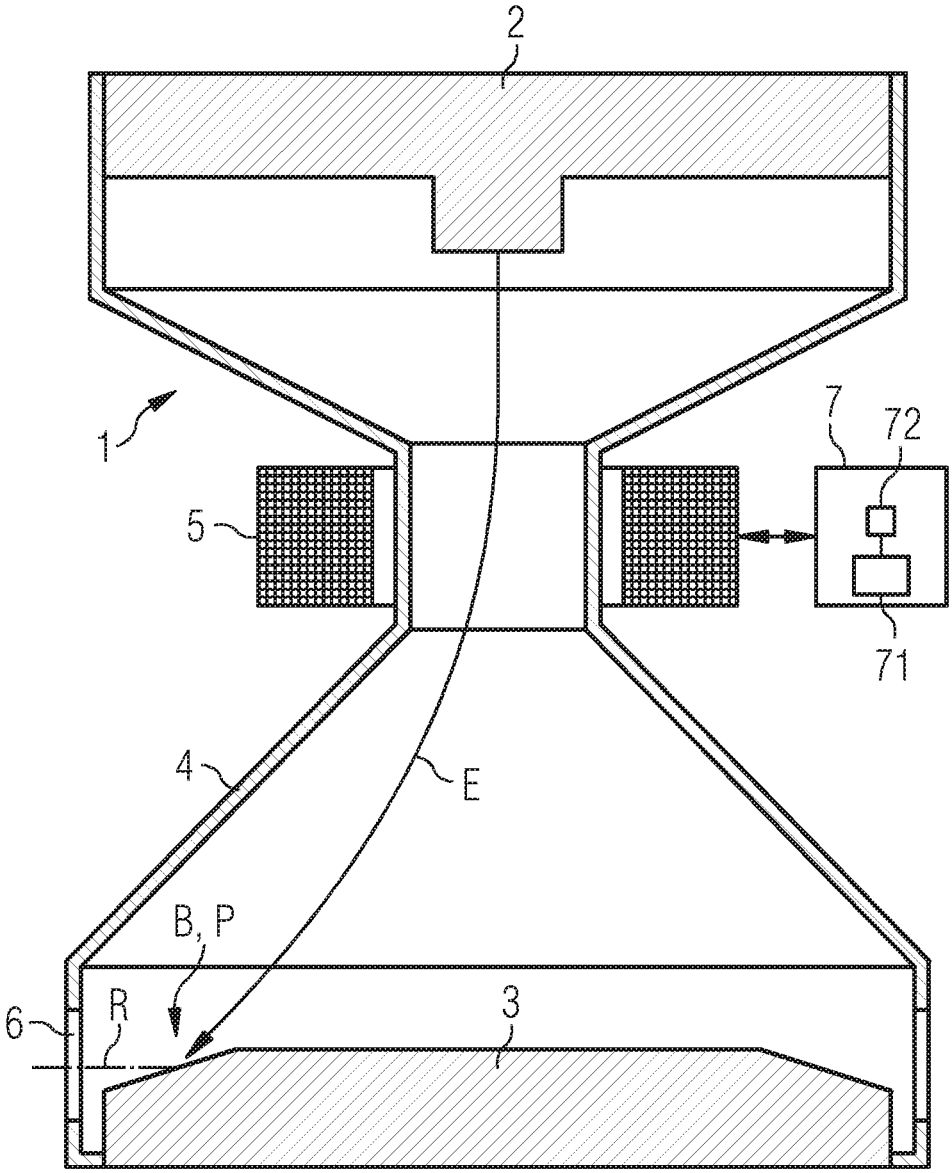
FIG. 1: shows an X-ray emitter comprising a rotary piston X-ray tube according to a first embodiment, in a diagram showing a cross section view.

Components that remain the same are denoted by the same reference signs in all the figures.

DETAILED DESCRIPTION OF THE EXAMPLE EMBODIMENTS

The drawings are to be regarded as being schematic representations and elements illustrated in the drawings are not necessarily shown to scale. Rather, the various elements are represented such that their function and general purpose become apparent to a person skilled in the art. Any connection or coupling between functional blocks, devices, components, or other physical or functional units shown in the drawings or described herein may also be implemented by an indirect connection or coupling. A coupling between components may also be established over a wireless connection. Functional blocks may be implemented in hardware, firmware, software, or a combination thereof.

Various example embodiments will now be described more fully with reference to the accompanying drawings in which only some example embodiments are shown. Specific structural and functional details disclosed herein are merely representative for purposes of describing example embodiments. Example embodiments, however, may be embodied in various different forms, and should not be construed as being limited to only the illustrated embodiments. Rather, the illustrated embodiments are provided as examples so that this disclosure will be thorough and complete, and will fully convey the concepts of this disclosure to those skilled in the art. Accordingly, known processes, elements, and techniques, may not be described with respect to some example embodiments. Unless otherwise noted, like reference characters denote like elements throughout the attached drawings and written description, and thus descriptions will not be repeated. The present invention, however, may be embodied in many alternate forms and should not be construed as limited to only the example embodiments set forth herein.

It will be understood that, although the terms first, second, etc. may be used herein to describe various elements, components, regions, layers, and/or sections, these elements, components, regions, layers, and/or sections, should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items. The phrase "at least one of" has the same meaning as "and/or".

Spatially relative terms, such as "beneath," "below," "lower," "under," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below," "beneath," or "under," other elements or features would then be oriented "above" the other elements or features. Thus, the example terms "below" and "under" may encompass both an orientation of above and below. The device may be otherwise oriented (rotated 90 degrees or at other orientations) and the spatially relative descriptors used herein interpreted accordingly. In addition, when an element is referred to as being "between" two elements, the element may be the only element between the two elements, or one or more other intervening elements may be present.

Spatial and functional relationships between elements (for example, between modules) are described using various terms, including "connected," "engaged," "interfaced," and "coupled." Unless explicitly described as being "direct," when a relationship between first and second elements is described in the above disclosure, that relationship encompasses a direct relationship where no other intervening elements are present between the first and second elements, and also an indirect relationship where one or more intervening elements are present (either spatially or functionally) between the first and second elements. In contrast, when an element is referred to as being "directly" connected, engaged, interfaced, or coupled to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Also, the term "exemplary" is intended to refer to an example or illustration.

When an element is referred to as being "on," "connected to," "coupled to," or "adjacent to," another element, the element may be directly on, connected to, coupled to, or adjacent to, the other element, or one or more other intervening elements may be present. In contrast, when an element is referred to as being "directly on," "directly connected to," "directly coupled to," or "immediately adjacent to," another element there are no intervening elements present.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Before discussing example embodiments in more detail, it is noted that some example embodiments may be described with reference to acts and symbolic representations of operations (e.g., in the form of flow charts, flow diagrams, data flow diagrams, structure diagrams, block diagrams, etc.) that may be implemented in conjunction with units and/or devices discussed in more detail below. Although discussed in a particularly manner, a function or operation specified in a specific block may be performed differently from the flow specified in a flowchart, flow diagram, etc. For example, functions or operations illustrated as being performed serially in two consecutive blocks may actually be performed simultaneously, or in some cases be performed in reverse order. Although the flowcharts describe the operations as sequential processes, many of the operations may be performed in parallel, concurrently or simultaneously. In addition, the order of operations may be re-arranged. The processes may be terminated when their operations are completed, but may also have additional steps not included in the figure. The processes may correspond to methods, functions, procedures, subroutines, subprograms, etc.

Specific structural and functional details disclosed herein are merely representative for purposes of describing example embodiments of the present invention. This invention may, however, be embodied in many alternate forms and should not be construed as limited to only the embodiments set forth herein.

Units and/or devices according to one or more example embodiments may be implemented using hardware, software, and/or a combination thereof. For example, hardware devices may be implemented using processing circuitry such as, but not limited to, a processor, Central Processing Unit (CPU), a controller, an arithmetic logic unit (ALU), a digital signal processor, a microcomputer, a field programmable gate array (FPGA), a System-on-Chip (SoC), a programmable logic unit, a microprocessor, or any other device capable of responding to and executing instructions in a defined manner. Portions of the example embodiments and corresponding detailed description may be presented in terms of software, or algorithms and symbolic representations of operation on data bits within a computer memory. These descriptions and representations are the ones by which those of ordinary skill in the art effectively convey the substance of their work to others of ordinary skill in the art. An algorithm, as the term is used here, and as it is used generally, is conceived to be a self-consistent sequence of steps leading to a desired result. The steps are those requiring physical manipulations of physical quantities. Usually, though not necessarily, these quantities take the form of optical, electrical, or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise, or as is apparent from the discussion, terms such as "processing" or "computing" or "calculating" or "determining" of "displaying" or the like, refer to the action and processes of a computer system, or similar electronic computing device/hardware, that manipulates and transforms data represented as physical, electronic quantities within the computer system's registers and memories into other data similarly represented as physical quantities within the computer system memories or registers or other such information storage, transmission or display devices.

In this application, including the definitions below, the term 'module' or the term 'controller' may be replaced with the term 'circuit.' The term 'module' may refer to, be part of, or include processor hardware (shared, dedicated, or group) that executes code and memory hardware (shared, dedicated, or group) that stores code executed by the processor hardware.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

Software may include a computer program, program code, instructions, or some combination thereof, for independently or collectively instructing or configuring a hardware device to operate as desired. The computer program and/or program code may include program or computer-readable instructions, software components, software modules, data files, data structures, and/or the like, capable of being implemented by one or more hardware devices, such as one or more of the hardware devices mentioned above. Examples of program code include both machine code produced by a compiler and higher level program code that is executed using an interpreter.

For example, when a hardware device is a computer processing device (e.g., a processor, Central Processing Unit (CPU), a controller, an arithmetic logic unit (ALU), a digital signal processor, a microcomputer, a microprocessor, etc.), the computer processing device may be configured to carry out program code by performing arithmetical, logical, and input/output operations, according to the program code. Once the program code is loaded into a computer processing device, the computer processing device may be programmed to perform the program code, thereby transforming the computer processing device into a special purpose computer processing device. In a more specific example, when the program code is loaded into a processor, the processor becomes programmed to perform the program code and operations corresponding thereto, thereby transforming the processor into a special purpose processor.

Software and/or data may be embodied permanently or temporarily in any type of machine, component, physical or virtual equipment, or computer storage medium or device, capable of providing instructions or data to, or being interpreted by, a hardware device. The software also may be distributed over network coupled computer systems so that the software is stored and executed in a distributed fashion. In particular, for example, software and data may be stored by one or more computer readable recording mediums, including the tangible or non-transitory computer-readable storage media discussed herein.

Even further, any of the disclosed methods may be embodied in the form of a program or software. The program or software may be stored on a non-transitory computer readable medium and is adapted to perform any one of the aforementioned methods when run on a computer device (a device including a processor). Thus, the non-transitory, tangible computer readable medium, is adapted to store information and is adapted to interact with a data processing facility or computer device to execute the program of any of the above mentioned embodiments and/or to perform the method of any of the above mentioned embodiments.

Example embodiments may be described with reference to acts and symbolic representations of operations (e.g., in the form of flow charts, flow diagrams, data flow diagrams, structure diagrams, block diagrams, etc.) that may be implemented in conjunction with units and/or devices discussed in more detail below. Although discussed in a particularly manner, a function or operation specified in a specific block may be performed differently from the flow specified in a flowchart, flow diagram, etc. For example, functions or operations illustrated as being performed serially in two consecutive blocks may actually be performed simultaneously, or in some cases be performed in reverse order.

According to one or more example embodiments, computer processing devices may be described as including various functional units that perform various operations and/or functions to increase the clarity of the description. However, computer processing devices are not intended to be limited to these functional units. For example, in one or more example embodiments, the various operations and/or functions of the functional units may be performed by other ones of the functional units. Further, the computer processing devices may perform the operations and/or functions of the various functional units without sub-dividing the operations and/or functions of the computer processing units into these various functional units.

Units and/or devices according to one or more example embodiments may also include one or more storage devices. The one or more storage devices may be tangible or non-transitory computer-readable storage media, such as random access memory (RAM), read only memory (ROM), a permanent mass storage device (such as a disk drive), solid state (e.g., NAND flash) device, and/or any other like data storage mechanism capable of storing and recording data. The one or more storage devices may be configured to store computer programs, program code, instructions, or some combination thereof, for one or more operating systems and/or for implementing the example embodiments described herein. The computer programs, program code, instructions, or some combination thereof, may also be loaded from a separate computer readable storage medium into the one or more storage devices and/or one or more computer processing devices using a drive mechanism. Such separate computer readable storage medium may include a Universal Serial Bus (USB) flash drive, a memory stick, a Blu-ray/DVD/CD-ROM drive, a memory card, and/or other like computer readable storage media. The computer programs, program code, instructions, or some combination thereof, may be loaded into the one or more storage devices and/or the one or more computer processing devices from a remote data storage device via a network interface, rather than via a local computer readable storage medium. Additionally, the computer programs, program code, instructions, or some combination thereof, may be loaded into the one or more storage devices and/or the one or more processors from a remote computing system that is configured to transfer and/or distribute the computer programs, program code, instructions, or some combination thereof, over a network. The remote computing system may transfer and/or distribute the computer programs, program code, instructions, or some combination thereof, via a wired interface, an air interface, and/or any other like medium.

The one or more hardware devices, the one or more storage devices, and/or the computer programs, program code, instructions, or some combination thereof, may be specially designed and constructed for the purposes of the example embodiments, or they may be known devices that are altered and/or modified for the purposes of example embodiments.

A hardware device, such as a computer processing device, may run an operating system (OS) and one or more software applications that run on the OS. The computer processing device also may access, store, manipulate, process, and create data in response to execution of the software. For simplicity, one or more example embodiments may be exemplified as a computer processing device or processor; however, one skilled in the art will appreciate that a hardware device may include multiple processing elements or processors and multiple types of processing elements or processors. For example, a hardware device may include multiple processors or a processor and a controller. In addition, other processing configurations are possible, such as parallel processors.

The computer programs include processor-executable instructions that are stored on at least one non-transitory computer-readable medium (memory). The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc. As such, the one or more processors may be configured to execute the processor executable instructions.

The computer programs may include: (i) descriptive text to be parsed, such as HTML (hypertext markup language) or XML (extensible markup language), (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective-C, Haskell, Go, SQL, R, Lisp, Java®, Fortran, Perl, Pascal, Curl, OCaml, Javascript®, HTML5, Ada, ASP (active server pages), PHP, Scala, Eiffel, Smalltalk, Erlang, Ruby, Flash®, Visual Basic®, Lua, and Python®.

Further, at least one embodiment of the invention relates to the non-transitory computer-readable storage medium including electronically readable control information (processor executable instructions) stored thereon, configured in such that when the storage medium is used in a controller of a device, at least one embodiment of the method may be carried out.

The computer readable medium or storage medium may be a built-in medium installed inside a computer device main body or a removable medium arranged so that it can be separated from the computer device main body. The term computer-readable medium, as used herein, does not encompass transitory electrical or electromagnetic signals propagating through a medium (such as on a carrier wave); the term computer-readable medium is therefore considered tangible and non-transitory. Non-limiting examples of the non-transitory computer-readable medium include, but are not limited to, rewriteable non-volatile memory devices (including, for example flash memory devices, erasable programmable read-only memory devices, or a mask read-only memory devices); volatile memory devices (including, for example static random access memory devices or a dynamic random access memory devices); magnetic storage media (including, for example an analog or digital magnetic tape or a hard disk drive); and optical storage media (including, for example a CD, a DVD, or a Blu-ray Disc). Examples of the media with a built-in rewriteable non-volatile memory, include but are not limited to memory cards; and media with a built-in ROM, including but not limited to ROM cassettes; etc. Furthermore, various information regarding stored images, for example, property information, may be stored in any other form, or it may be provided in other ways.

The term code, as used above, may include software, firmware, and/or microcode, and may refer to programs, routines, functions, classes, data structures, and/or objects.

Shared processor hardware encompasses a single microprocessor that executes some or all code from multiple modules. Group processor hardware encompasses a microprocessor that, in combination with additional microprocessors, executes some or all code from one or more modules. References to multiple microprocessors encompass multiple microprocessors on discrete dies, multiple microprocessors on a single die, multiple cores of a single microprocessor, multiple threads of a single microprocessor, or a combination of the above.

Shared memory hardware encompasses a single memory device that stores some or all code from multiple modules. Group memory hardware encompasses a memory device that, in combination with other memory devices, stores some or all code from one or more modules.

The term memory hardware is a subset of the term computer-readable medium. The term computer-readable medium, as used herein, does not encompass transitory electrical or electromagnetic signals propagating through a medium (such as on a carrier wave); the term computer-readable medium is therefore considered tangible and non-transitory. Non-limiting examples of the non-transitory computer-readable medium include, but are not limited to, rewriteable non-volatile memory devices (including, for example flash memory devices, erasable programmable read-only memory devices, or a mask read-only memory devices); volatile memory devices (including, for example static random access memory devices or a dynamic random access memory devices); magnetic storage media (including, for example an analog or digital magnetic tape or a hard disk drive); and optical storage media (including, for example a CD, a DVD, or a Blu-ray Disc). Examples of the media with a built-in rewriteable non-volatile memory, include but are not limited to memory cards; and media with a built-in ROM, including but not limited to ROM cassettes; etc. Furthermore, various information regarding stored images, for example, property information, may be stored in any other form, or it may be provided in other ways.

The apparatuses and methods described in this application may be partially or fully implemented by a special purpose computer created by configuring a general purpose computer to execute one or more particular functions embodied in computer programs. The functional blocks and flowchart elements described above serve as software specifications, which can be translated into the computer programs by the routine work of a skilled technician or programmer.

Although described with reference to specific examples and drawings, modifications, additions and substitutions of example embodiments may be variously made according to the description by those of ordinary skill in the art. For example, the described techniques may be performed in an order different with that of the methods described, and/or components such as the described system, architecture, devices, circuit, and the like, may be connected or combined to be different from the above-described methods, or results may be appropriately achieved by other components or equivalents.

An X-ray emitter of at least one embodiment comprises an anode arranged inside a vacuum housing, wherein at least the anode is rotatably mounted and can be set into rotation by an electric drive. In the region of a focal spot, the anode can be exposed to an electron beam emitted by a cathode. According to at least one embodiment of the invention, a control unit is provided which activates an electromagnetic deflection unit that deflects the electron beam such that a movement of the focal spot caused by electromagnetic fields of the electric drive can be at least partly compensated for, as a function of at least one operating parameter of the electric drive.

The basic concept underlying at least one embodiment of the invention is therefore the realization that the movement of the focal spot is at least in part directly caused by electromagnetic fields that are generated when the electric drive is in operation. This measurable influence on the position and in some cases also on the extent of the focal spot can be compensated for by the control of the electromagnetic deflection unit, which includes, for example, one or a plurality of coils that deflect the electron beam, being achieved in accordance with values determined for the at least one operating parameter of the electric drive.

The relationship between the at least one operating parameter of the electric drive and the focal spot movement can be determined and recorded before the X-ray emitter goes into operation and can thus be taken as a basis for the control. In this way, for example, the periodic influence on the electron beam of the alternating fields caused by the electric drive can be largely compensated for before a change in the position of the electron beams is likely to occur. Compensation for the focal spot movement consequently ensues directly and in particular faster than with conventional controls, in which a significant deviation of the actual position of the focal spot from a predetermined set position first has to occur and be determined.

A control is meant to be characterized here by an open loop or by a closed loop, wherein the output values influenced by the input values do not again have an effect on themselves via the same input values.

Unaffected by this, the control unit of the X-ray emitter can nevertheless in particular be integrated in a higher level control circuit in the context of a feed-forward control. Such a control circuit requires active position detection of the focal spot during the operation of the X-ray emitter via measuring devices designed accordingly. The implementation of the control unit in the context of a feed-forward control in the higher level control circuit has the advantage that a direct compensation for that part of the focal spot movement which is caused by electromagnetic fields of the electric drive can ensue and in addition focal spot movements of a different origin, in particular of unknown origin, can be eliminated by the control.

In other cases, a simple compensation control without a higher level control circuit is provided. Furthermore, in this case, an active compensation of the focal spot movement using at least one operating parameter of the electric drive is facilitated, the position of the focal spot during the operation of the X-ray emitter not necessarily having to be detected.

The electromagnetic deflection unit includes, for example, one or a plurality of electromagnetic deflection coils with or without ferromagnetic cores or electrostatically chargeable deflection plates.

The anode in possible embodiments of the invention is designed as a rotatably mounted rotating anode inside the in particular stationary vacuum housing. In these embodiments the rotating anode is set into rotation in relation to the stationary vacuum housing and the cathode during operation, in order in particular to distribute a heat input that is acting on the anode over a greater surface.

In other possible embodiments the vacuum housing is rotatably mounted and can be set into rotation by the electric drive. The cathode and the anode are non-rotatably connected to the vacuum housing. In other words, the construction of the X-ray emitter corresponds to a rotary piston emitter, in which the vacuum housing that supports both the anode and the cathode during operation is moved into rotation or into a revolving motion.

In at least one embodiment, the operating parameter of the electric drive, on which parameter the control of the electromagnetic deflection unit is based, is a stator current amplitude and/or a stator current phase position. Particularly preferably, control is achieved as a function of a plurality of the values referred to in the aforementioned.

The movement of the focal spot can be broken down into two geometrical components, that is a radial component and a tangential component. The dependence of these components on one or a plurality of operating parameters, in particular on the given stator current amplitude and/or on the stator current phase position, can in particular ensue in a single calibration step. The dependencies that are determined can be stored in a storage medium, which is in operative connection with the control unit, such that this connection can be made the basis of the control when the X-ray emitter is in operation. The storage medium is preferably a non-volatile data memory, such as, for example, a ROM (read only memory), an EPROM (erasable programmable read only memory) or a flash memory.

The X-ray emitter, in at least one embodiment, includes a measuring unit that determines at least one operating parameter of the electric drive, which unit transmits a measurement signal to the control unit.

In a further embodiment of the invention, provision is made for the control unit to activate the electromagnetic deflection unit as a function of at least one additional operating parameter of the X-ray emitter. It has transpired that the focal spot movement that is correlated with the operating parameter(s) of the electric drive depends on further values, in particular on operating parameters that are assigned to the X-ray emitter. In this way these influences, which can in fact be measured, can be taken into account in the context of a control and/or of a feed-forward control.

The operating parameter of the X-ray emitter is, for example, a tube voltage. Alternatively or additionally, temperature-dependent electromagnetic effects can be taken into account by measuring a temperature, in particular an operating temperature of the X-ray emitter.

In this context, a further measuring unit, which detects the at least one operating parameter of the X-ray emitter, is advantageously provided. A measuring unit designed accordingly to determinate the tube voltage is provided on the high voltage generator, for example. Alternatively or additionally, a temperature sensor is incorporated in the X-ray emitter.

At least one embodiment of the invention is directed to a method for compensating for a focal spot movement. The advantages associated therewith emerge directly from the description set out in the aforementioned with reference to the X-ray emitter according to embodiments of the present invention.

In a method of at least one embodiment for compensating for the focal spot movement when the aforementioned X-ray emitter is in operation, an anode arranged inside a vacuum housing is provided, which anode is exposed to an electron beam in order to generate X-ray radiation. The anode at least is rotatably mounted for this purpose and is set into rotation by an electric drive.

According to at least one embodiment of the invention, a control unit activates an electromagnetic deflection unit that deflects an electron beam as a function of at least one operating parameter of the electric drive such that a movement of the focal spot caused by electromagnetic fields in the electric drive is at least partly compensated for.

The dependence of the focal spot movement on the operating parameters of the electric drive is a measurable effect which can be determined and recorded in particular in a single calibration measurement. This forms the basis of the compensation for the part of the focal spot movement that is caused by electromagnetic fields that occur when the electric drive is in operation. In this respect a determination of a deviation is unnecessary, that is, a detection of the position of the focal spot during operation is not absolutely necessary. The method can be therefore be implemented in a simple compensation control.

The method, in at least one embodiment of the invention, can also be implemented advantageously in the context of a feed-forward control in a higher level control with active detection of the focal spot movement. The control of the electromagnetic deflection unit to compensate for the movement of the focal spot caused by electromagnetic fields of the electric drive then ensues as a subsystem in a control circuit, in which the actual position of the focal spot is actively determined as a control variable during operation. The influence of the electric drive on the focal spot movement can consequently be at least partly eliminated in advance, without a response from the higher level control being necessary for this. In the ideal scenario, any influence of the electric drive on the focal spot movement is completely eliminated, such that any set-point deviation that occurs whereby the actual position of the focal spot deviates significantly from the set position has a different origin.

The feed-forward control forms a control that is superimposed on the control circuit. In such embodiments, the influence of the electric drive is at least partly eliminated by the additional control signals from the feed-forward control, while the performance of the rest of the control circuit, in particular the stability and system management, ideally remains unchanged.

The control unit, in at least one embodiment, activates the electromagnetic deflection unit as a function of at least one additional operating parameter of the X-ray emitter. In these embodiments, a complex control ensues as a function of a plurality of values, which can be determined, however, in an appropriately comprehensive calibration measurement before the X-ray emitter goes into operation. This makes it possible to take into account further measurable disturbance factors, which directly or indirectly influence in particular the electromagnetic fields that occur during operation, in the context of control or feed-forward control. Examples of such operating parameters of the X-ray emitter are the current tube voltage or a temperature, in particular an operating temperature, of the X-ray emitter.

The dependence of the focal spot movement on the at least one operating parameter of the electric drive and/or on the at least one operating parameter of the X-ray emitter is determined in a calibration step and preferably stored in a storage medium, in particular stored in a non-volatile data memory such as an EEPROM or flash memory, as a discrete data structure. A discrete data structure is defined as a structure in which discrete values of the correlated parameters are assigned to one another. For example, the discrete data structure may take the form of a multidimensional look-up table.

In at least one embodiment, the discrete data structure is for generating control signals that activate the electromagnetic deflection unit is interpolated. The interim values required to control the electromagnetic deflection unit are therefore formed from the stored discrete values by way of an appropriate interpolation. For this purpose, the control unit is equipped with appropriate computation device that include, for example microprocessors, microcontrollers, integrated circuits or suchlike. Preferably, a linear interpolation of the discrete data structure occurs, in other applications an interpolation of a higher order, that is, an interpolation of a quadratic or higher order. A reduction of the results to analytical equations and hence a reduction of the parameters is also proposed as a possible implementation.

In at least one embodiment, the X-ray emitter described in the aforementioned and/or the method described in the aforementioned to compensate for the focal spot movement is used in an X-ray imaging apparatus. Said X-ray imaging apparatus is, for example, intended for medical imaging, for examining materials or for checking luggage. Particularly preferably, the X-ray imaging apparatus is designed as a computer tomography unit or a C-arm X-ray device.

FIG. 1 shows an X-ray emitter 1 designed as a rotary piston emitter according to a first embodiment. The X-ray emitter 1 includes a cathode 2 and a rotatably mounted rotating anode 3, which are non-rotatably mounted inside a rotatably mounted vacuum housing 4. When the X-ray emitter 1 is in operation, the evacuated vacuum housing 4 of an electric drive that is not shown in further detail in FIG. 1 (compare this with the electric drive in FIG. 2 marked with 8) is set into rotation. A high voltage is applied between the cathode 2 and the anode 3 when the X-ray emitter 1 is in operation, such that an electron beam E is emitted by the cathode 1, which beam impinges on the anode 3. So that the anode 3 is exposed to the electron beam E in the peripheral lateral area intended for this purpose, the electron beam E is appropriately focused and deflected. For this purpose, a deflection unit 5 is provided, which in the embodiment shown by way of example is designed as an electromagnetic deflection coil. The electron beam E impinges on the material of the anode 3 in the region of what is known as the focal spot B. The resulting X-ray radiation R is emitted laterally from the X-ray emitter 1 via an emission window 6.

The position of the focal spot B is generally influenced by various disturbance factors during operation. To compensate for a focal spot movement caused by one of these disturbance factors, the electromagnetic deflection unit 5 generates a time-variable deflection field accordingly directed against it. For this purpose, the electromagnetic or electrostatic deflection unit 5 is connected to a control unit 7, which provides control signals that ensue according to previously determined correlations that characterize the focal spot movement as a function of operating parameters of the electric drive that is not shown in further detail in FIG. 1. These correlations at least partly take into account the influence of the electric drive on the time-variable position P of the focal spot B and are stored on a storage medium 71 of the control unit 7 in a discrete data structure, for example, in the form of a look-up table. The control unit 71 further comprises digital computation device 9, such as microprocessors or integrated circuits, which are designed to carry out any computing operation necessary for control. The computation device 72 are designed in particular to calculate further interim values for control from the values stored in the discrete data structure by way of interpolation of the first or higher order.

The values to be stored in the data structure, which characterize the dependence of the time-variable position P of the focal spot B on operating parameters of the electric drive 8 are stored beforehand, that is, determined during the calibration of the X-ray emitter 1 in calibration measurements and stored in the storage medium 71.

Figure 2:
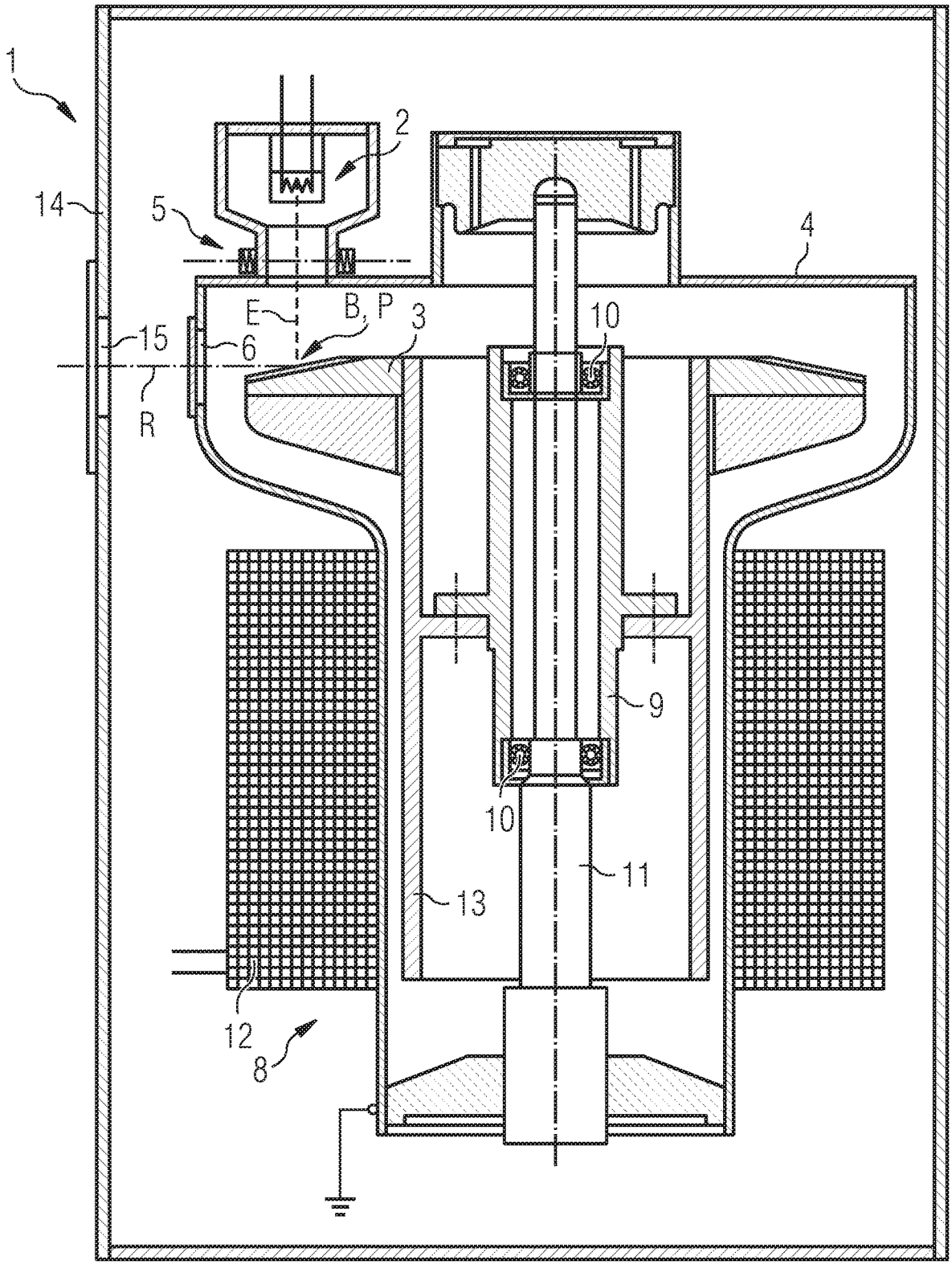
FIG. 2: shows an X-ray emitter comprising a rotating anode according to a second embodiment, in a diagram showing a cross section view.

FIG. 2 shows a further embodiment of the X-ray emitter 1 with a cathode 2 and an anode 3 that is designed as a rotating anode. In this embodiment, the electric drive 8 that drives the rotating anode is shown explicitly. The anode 3 that is designed as a rotating anode has a hollow shaft 9, which is rotatably mounted in relation to a fixed shaft 11 via bearings 10, in particular via ball bearings.

The electric drive 8 in the embodiment shown is a squirrel-cage motor and includes, in a manner that is in fact known, a stator 12 and a rotor 13 that is non-rotatably connected to the rotating anode 3.

The X-ray emitter 1 in the second embodiment, shown in FIG. 2, further includes a protective housing 14 that surrounds the evacuated vacuum housing 4, which protective housing comprises a further emission window. The protective housing 14 is filled with a coolant, for example with an insulating oil.

The deflection unit 5 in the second embodiment is activated by the control unit 7, which is not shown in further detail in FIG. 2, as a function of operating parameters of the electric drive 8. The operating parameter of the electric drive 8 that is considered is preferably a stator current amplitude A or a stator current phase position Ph, it being possible when determining the focal spot movements caused by the electric drive 8 to take into account in addition the load-dependent rotor slippage.

Figure 3:
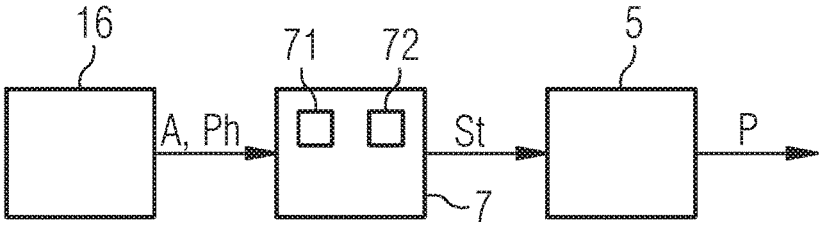
FIG. 3: shows the design of a control of an electromagnetic or electrostatic deflection unit according to a first embodiment.

FIG. 3 illustrates in diagram form a method for compensating for focal spot movement in the context of a simple compensation control. A detection of the position of the focal spot B during the operation of the X-ray emitter 1 is not necessary in this case since the control is based entirely on the correlations between stored values for the operating parameters of the electric drive 8 and the position P of the focal spot B in the form of a discrete data structure.

During the operation of the X-ray emitter 1, the stator current amplitude A and stator current phase position Ph are measured using measuring device 16. The current values for these operating parameters of the electric drive 8 are supplied to the control unit 7. By way of the correlations stored in the storage medium 71 between stator current amplitude A and stator current phase position Ph in the first instance and the position P of the focal spot B in the second instance, the control unit 7 generates control signals St for the electromagnetic deflection unit 5, such that the variation in the focal spot position induced by the fields in the electric drive 8 is at least partly compensated for. For this purpose, the discrete values stored in the storage medium 71 are optionally interpolated via the computation device 72 in a linear manner or with a higher order.

Figure 4:
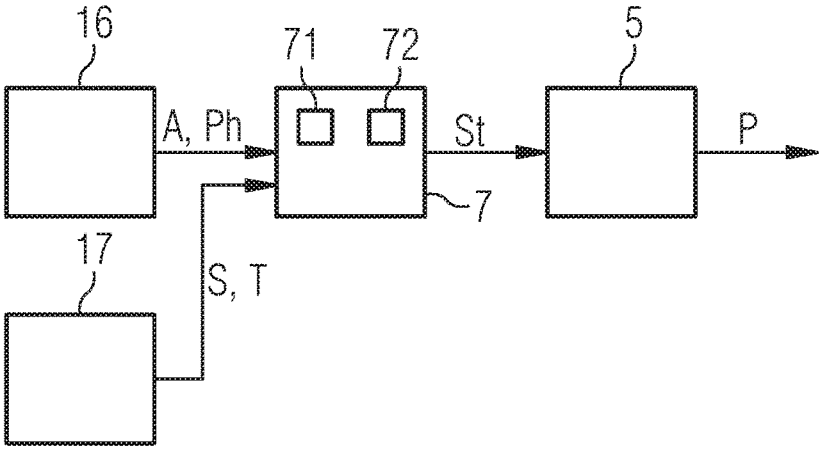
FIG. 4: shows the design of a control of an electromagnetic or electrostatic deflection unit according to a second embodiment.

FIG. 4 shows an embodiment, in which the control in FIG. 3 is extended by having additional further operating parameters assigned to the X-ray emitter 1 during the operation of further measurement device 17 and are consequently taken into account. In concrete terms, these further values are a tube voltage S that is prevalent between the cathode 2 and the anode 3 and a temperature T. The data stored in the storage medium 71 are complemented by the corresponding dependencies with regard to the position P of the focal spot B. The data structure stored in the storage medium 71 takes the form of a multidimensional look-up table. In this way, the influence of the tube voltage S or temperature-dependent effects on the position P of the focal spot B in the context of the illustrated compensation control are taken into account.

Figure 5:
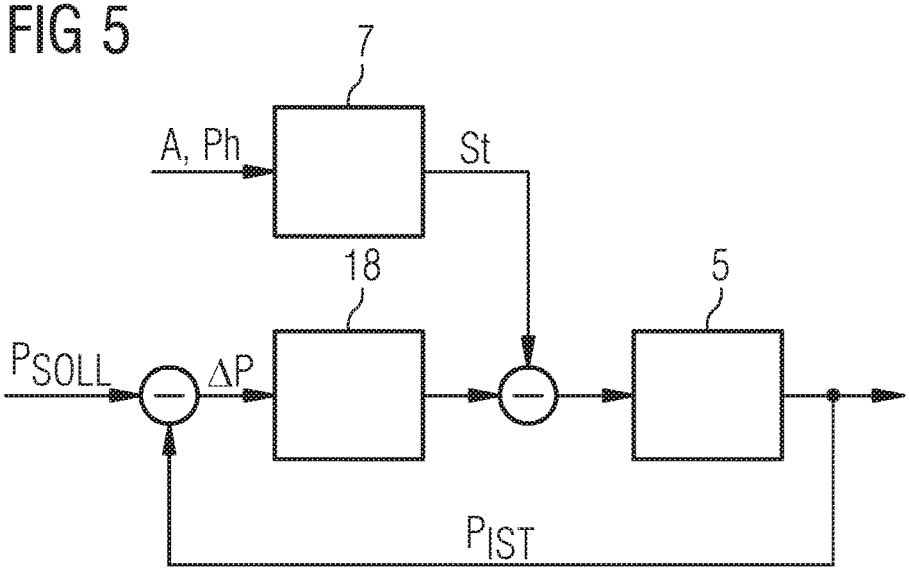
FIG. 5: shows a control of the focal spot movement with feed-forward control.

FIG. 5 illustrates a control circuit of an active control of the position P of the focal spot B, wherein the control illustrated in FIG. 3 or 4 is implemented as a feed-forward control. The position P of the focal spot B is therefore the control variable, which is actively determined as an actual position $P_{Ist}$ and is supplied to an input of a control device

18. From a given target position $P_{Soll}$ a control deviation ΔP is calculated by way of the actual position $P_{Ist}$ in what is a known manner. The control device 18 activates the electromagnetic deflection unit 5 as a function of this control deviation ΔP, where the control signal St provided by the control apparatus 7 is taken into account in the context of a feed-forward control. In this way, the focal spot movements caused by the electromagnetic fields of the electric drive 8 are already compensated for such that, in the ideal scenario, the further control deviations ΔP are of a different origin.

Although the invention has been illustrated and described in greater detail with the preferred embodiments, the invention is not restricted by this. Other variants and combinations can be derived therefrom by a person skilled in the art, without going beyond the basic inventive concept.

The patent claims of the application are formulation proposals without prejudice for obtaining more extensive patent protection. The applicant reserves the right to claim even further combinations of features previously disclosed only in the description and/or drawings.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

None of the elements recited in the claims are intended to be a means-plus-function element within the meaning of 35 U.S.C. § 112(f) unless an element is expressly recited using the phrase "means for" or, in the case of a method claim, using the phrases "operation for" or "step for."

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An X-ray emitter, comprising:

a vacuum housing;

a cathode, arranged inside the vacuum housing;

an anode, arranged inside the vacuum housing, at least the anode being rotatable, the anode being configured to be set into rotation by an electric drive and being exposable, in a region of a focal spot, to an electron beam emitted by a cathode; and an electromagnetic deflection unit, activatable by a controller, to deflect the electron beam as a function of at least one operating parameter of the electric drive, to at least partially compensate for a movement of the focal spot caused by electromagnetic fields of the electric drive.

2. The X-ray emitter of claim 1, wherein the anode is designed as a rotating anode, rotatably mounted inside the vacuum housing.

3. The X-ray emitter of claim 2, wherein the vacuum housing is rotatably mounted and is configured to be set into rotation by the electric drive, wherein the cathode and the anode are non-rotatably connected to the vacuum housing.

4. The X-ray emitter of claim 2, wherein the at least one operating parameter of the electric drive includes at least one of a stator current amplitude and a stator current phase position.

5. The X-ray emitter of claim 2, wherein the controller is configured to activate the electromagnetic deflection unit as a function of at least one operating parameter of the X-ray emitter.

6. The X-ray emitter of claim 5, wherein the at least one operating parameter of the X-ray emitter is at least one of a tube voltage and a temperature.

7. The X-ray emitter of claim 1, wherein the vacuum housing is rotatably mounted and is configured to be set into rotation by the electric drive, wherein the cathode and the anode are non-rotatably connected to the vacuum housing.

8. The X-ray emitter of claim 7, wherein the at least one operating parameter of the electric drive includes at least one of a stator current amplitude and a stator current phase position.

9. The X-ray emitter of claim 7, wherein the controller is configured to activate the electromagnetic deflection unit as a function of at least one operating parameter of the X-ray emitter.

10. The X-ray emitter of claim 9, wherein the at least one operating parameter of the X-ray emitter is at least one of a tube voltage and a temperature.

11. The X-ray emitter of claim 1, wherein the at least one operating parameter of the electric drive includes at least one of a stator current amplitude and a stator current phase position.

12. The X-ray emitter of claim 11, further comprising:

a measuring unit, to determine the at least one operating parameter of the electric drive.

13. The X-ray emitter of claim 1, further comprising:

a measuring unit, to determine the at least one operating parameter of the electric drive.

14. The X-ray emitter of claim 1, wherein the controller is configured to activate the electromagnetic deflection unit as a function of at least one operating parameter of the X-ray emitter.

15. The X-ray emitter of claim 14, wherein the at least one operating parameter of the X-ray emitter is at least one of a tube voltage and a temperature.

16. The X-ray emitter of claim 14, further comprising:

a further measuring unit, to determine the at least one operating parameter of the X-ray emitter.

17. The X-ray emitter of claim 1, wherein the vacuum housing is configured to be stationary.

18. A method for compensating for a focal spot movement during operation of an X-ray emitter, the X-ray emitter including an anode, arranged inside a vacuum housing, the anode being exposable to an electron beam to generate X-ray radiation, at least the anode being configured to be set into rotation by an electric drive, the method comprising:

activating a deflection unit, to deflect the electron beam as a function of at least one operating parameter of the electric drive, to at least partially compensate for a movement of a focal spot caused by electromagnetic fields of the electric drive.

19. The method of claim 18, wherein control of the deflection unit is implemented as a function of the at least one operating parameter of the electric drive in a context of a feed-forward control in a controller, with an actual position of the focal spot being determined as a control variable.

20. The method of claim 19, wherein the controller performs the activating of a deflection unit as a function of at least one operating parameter of the X-ray emitter.

21. The method of claim 19, wherein a dependence, of the movement of the focal spot on at least one of the at least one operating parameter of an electric drive and the at least one operating parameter of the X-ray emitter, is stored in a storage medium assigned to the controller as a discrete data structure.

22. The method of claim 21, wherein the discrete data structure, to generate control signals for the deflection unit, is interpolated.

23. The method of claim 19, wherein a dependence, of the movement of the focal spot on at least one of the at least one operating parameter of an electric drive and the at least one operating parameter of the X-ray emitter, is stored in a storage medium assigned to the controller as a discrete data structure, as a multidimensional look-up table.

24. The method of claim 18, wherein a controller performs the activating of the deflection unit as a function of at least one operating parameter of the X-ray emitter.

25. The method of claim 18, wherein a dependence, of the movement of the focal spot on the at least one operating parameter of the electric drive, is stored in a storage medium assigned to a controller as a discrete data structure.

26. The method of claim 25, wherein the discrete data structure, to generate control signals for the deflection unit, is interpolated.

27. The method of claim 18, wherein a dependence, of the movement of the focal spot on the at least one operating parameter of the electric drive, is stored in a storage medium assigned to a controller as a discrete data structure, as a multidimensional look-up table.

* * * * *